US006736581B1

(12) United States Patent
Cassoni et al.

(10) Patent No.: US 6,736,581 B1
(45) Date of Patent: May 18, 2004

(54) BOOK CLAMP

(75) Inventors: Robert Paul Cassoni, Centerville, OH (US); Alan Hardy Bailey, Bellbrook, OH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 492 days.

(21) Appl. No.: 09/352,250

(22) Filed: Jul. 13, 1999

(51) Int. Cl.[7] ..... B42C 13/00

(52) U.S. Cl. ..... 412/10; 24/67 R; 248/226.11; 294/104; 412/9; 412/23; D19/91

(58) Field of Search ..... 412/10, 22, 25, 412/23, 9; 100/1, 295, 32; 24/2, 17 A, 17 B, 18, 67 R, 67.3; 248/226.11, 316.1; D19/91; 294/104

(56) References Cited

U.S. PATENT DOCUMENTS

| | | | | | |
|---|---|---|---|---|---|
| 354,953 | A | * | 12/1886 | Tracey | |
| 1,114,740 | A | * | 10/1914 | Etheridge | |
| 1,734,901 | A | * | 11/1929 | Gerrie | |
| 1,928,789 | A | * | 10/1933 | Legge | |
| 3,223,436 | A | * | 12/1965 | Becker | 281/21 |
| 3,633,727 | A | * | 1/1972 | Brenner | 198/27 |
| 3,702,129 | A | | 11/1972 | Hawkes et al. | |
| 3,889,914 | A | * | 6/1975 | Torme | 248/445 |
| 4,467,912 | A | * | 8/1984 | Rathert | 198/650 |
| 4,507,036 | A | * | 3/1985 | Rathert | 412/9 |
| 4,925,144 | A | * | 5/1990 | White | 248/445 |
| 5,102,087 | A | * | 4/1992 | Brunell | 248/451 |
| 5,141,377 | A | * | 8/1992 | Rathert | 412/22 |
| 5,485,980 | A | * | 1/1996 | Luccia | 248/445 |
| 5,868,099 | A | * | 2/1999 | Begin | 116/234 |
| 5,871,323 | A | * | 2/1999 | Clark | 412/4 |
| D420,391 | S | * | 2/2000 | Nelson | D19/91 |
| 6,019,339 | A | * | 2/2000 | Brayford | 248/444.1 |
| 6,019,560 | A | * | 2/2000 | Uchida et al. | 412/25 |
| 6,119,992 | A | * | 9/2000 | Stuart | 248/231.71 |
| 6,227,588 | B1 | * | 5/2001 | Cassoni | 294/104 |

FOREIGN PATENT DOCUMENTS

| | | | |
|---|---|---|---|
| EP | 1072437 | * | 6/2000 |
| JP | 2001-47764 | * | 2/2001 |

* cited by examiner

*Primary Examiner*—Monica S. Carter
(74) *Attorney, Agent, or Firm*—Laurence A. Greenberg; Werner H. Stemer; Gregory L. Mayback

(57) ABSTRACT

A book clamp for a book binding machine has a first clamp member and a second clamp member. The second clamp member is adapted to the first clamp member and the second clamp member comprises a flexible spring plate which is coupled to the second clamp member.

17 Claims, 6 Drawing Sheets

BOOK CLAMP

BACKGROUND OF THE INVENTION

Field of the Invention

This invention relates generally to a book clamp of a book binding machine and more particularly to a book clamp which is adapted to the demand of clamping books having a variation in thicknesses across their entire length.

In the technology of binding books such as booklets, magazines, periodicals and the like the use of clamps is well known where the clamps are utilized to clamp a book comprising a bundle of sheets or signatures being collated before in order to hold together the plurality of sheets or signatures for the succeeding working step of binding the sheets or signatures by applying glue to the spine. The sheets or signatures are held in a fixed manner so that they may be conveyed along the binding machine wherein a number of necessary working steps are performed in order to properly bind the complete book.

A clamp of this kind is known, for example, from U.S. Pat. No. 3,702,129. This document discloses a book binding machine having a plurality of book clamps being coupled and driven by an endless chain along a path. Each of the clamps has an outer clamp assembly which is pivotally mounted along a horizontally extending axis to an inner clamp assembly. These clamps, however, are not adaptable to slight variations of the thickness along the length of one book which may, for example, arise from inserts added to the book which do not have the same length as the sheets or the signatures of the book.

SUMMARY OF THE INVENTION

It is therefore an object of the present invention to provide a book clamp, especially a book clamp to be used in a book binding machine, where this clamp provides sufficient clamping force to the entire length of the clamped book portion even in the case of thickness variations of the clamped book portion.

According to a first aspect, the present invention is directed to a book clamp for a book binding machine having a first clamp member and a second clamp member the second clamp member being adapted to said first clamp member, the second clamp member comprising a first flexible spring plate being coupled to the second clamp member.

According to further aspect of the present invention the book clamp of the book binding machine has a first clamp member and a second clamp member being coupled to said first clamp member where the second clamp member comprises a first and a second flexible spring plate both being mounted on the second clamp member.

By mounting a flexible spring plate onto the second clamp member of the book clamp it is possible to adjust the clamping force to slight variations of the thickness across the book which primarily may be caused by inserts having a smaller size than the sheets or the signatures of the book. In addition, the shape of the spring plates allows for a two point contact normal to the spine length which enhances the frictional grip force significantly and, as a consequence, improves the pull force required at the leading corner to pull up the book of the clamp.

With the objects of the invention in view, there is also provided a book clamp for a book binding machine, the book clamp including a first clamp member, a second clamp member connected to the first clamp member, and a pressure plate connected to the second clamp member. The pressure plate has a flexible spring plate for pressing a book against the first clamp member and a second flexible spring plate for pressing a book against the first clamp member. The second flexible spring plate has an overlap portion and a portion of the first flexible spring plate overlaps the overlap portion.

In accordance with a concomitant feature of the invention, the flexible spring plate defines a concave surface facing the first clamp member and the second flexible spring plate has an overlap portion and a portion of the first flexible spring plate overlaps the overlap portion.

The foregoing and other objects and features of the present invention will become more apparent upon the consideration of the following description taken into connection with the accompanying drawings.

DESCRIPTION OF THE PREFERRED EMBODIMENTS

Figure 1:
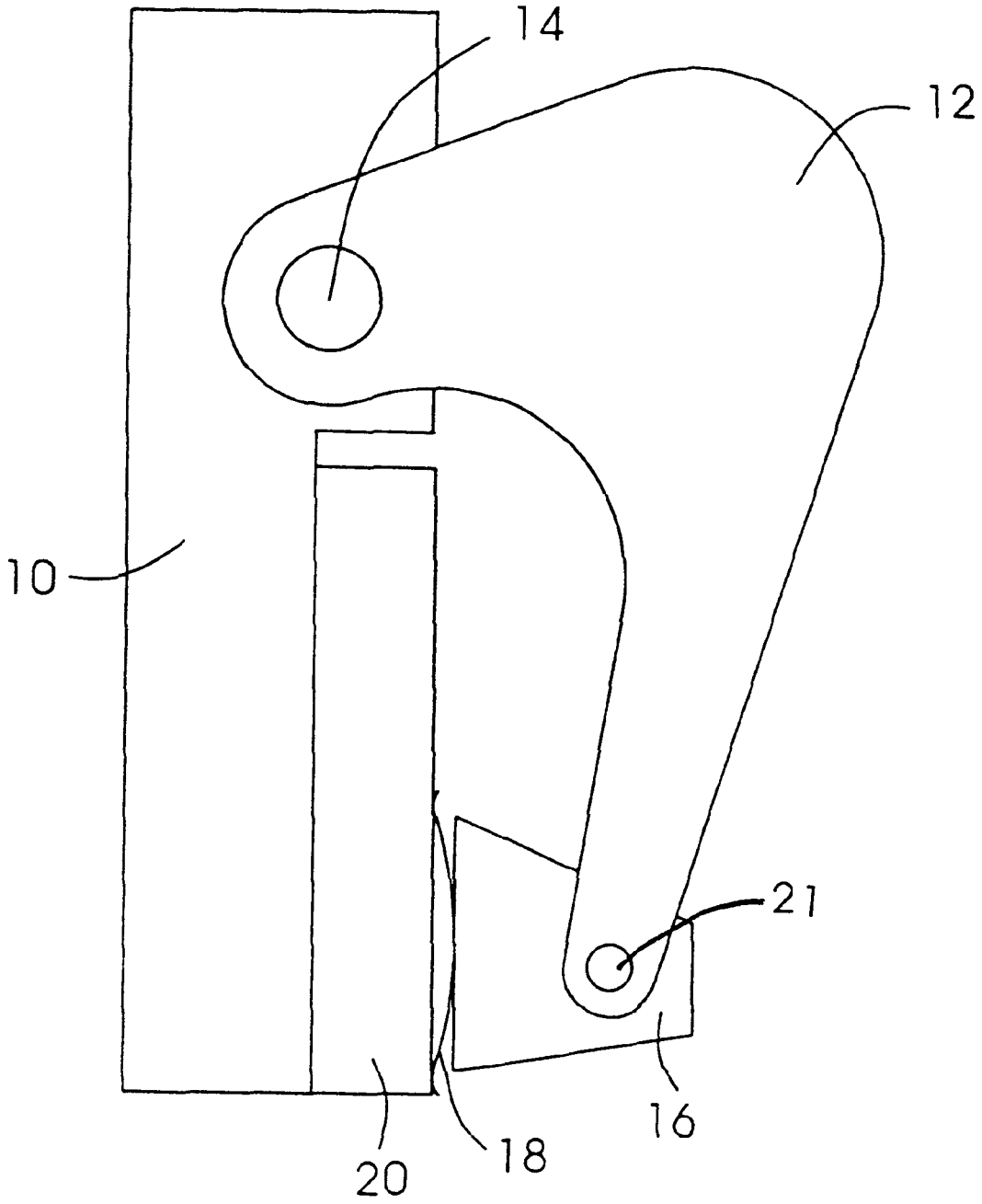
FIG. 1 is a schematic side view of the book clamp according to the present invention.

Referring now more in detail to the drawings and particularly to FIG. 1 a book clamp according to the present invention may include a first clamp member 10 and a second clamp member 12 where the second clamp member 12 is pivotally mounted on the first clamp member 10 at a hinge point 14. The second clamp member 12 which also may be called the outer clamp member is connected to a pressure plate 16 at a second hinge point 21. A spring plate 18 is mounted preferably on the pressure plate 16. A book 20, which may comprise a plurality of sheets or signatures is clamped between the first clamp member 10, the so called inner clamp member and the second clamp member 12, where the second clamp member 12 does not directly touch the book but via the spring plate 18. As the spring plate may be mounted to the second clamp member 12 it is advantageous to mount the spring plate to a pressure plate 16 which may be part of the second clamp member 12 or which is coupled to the second clamp member 12.

Figure 2:
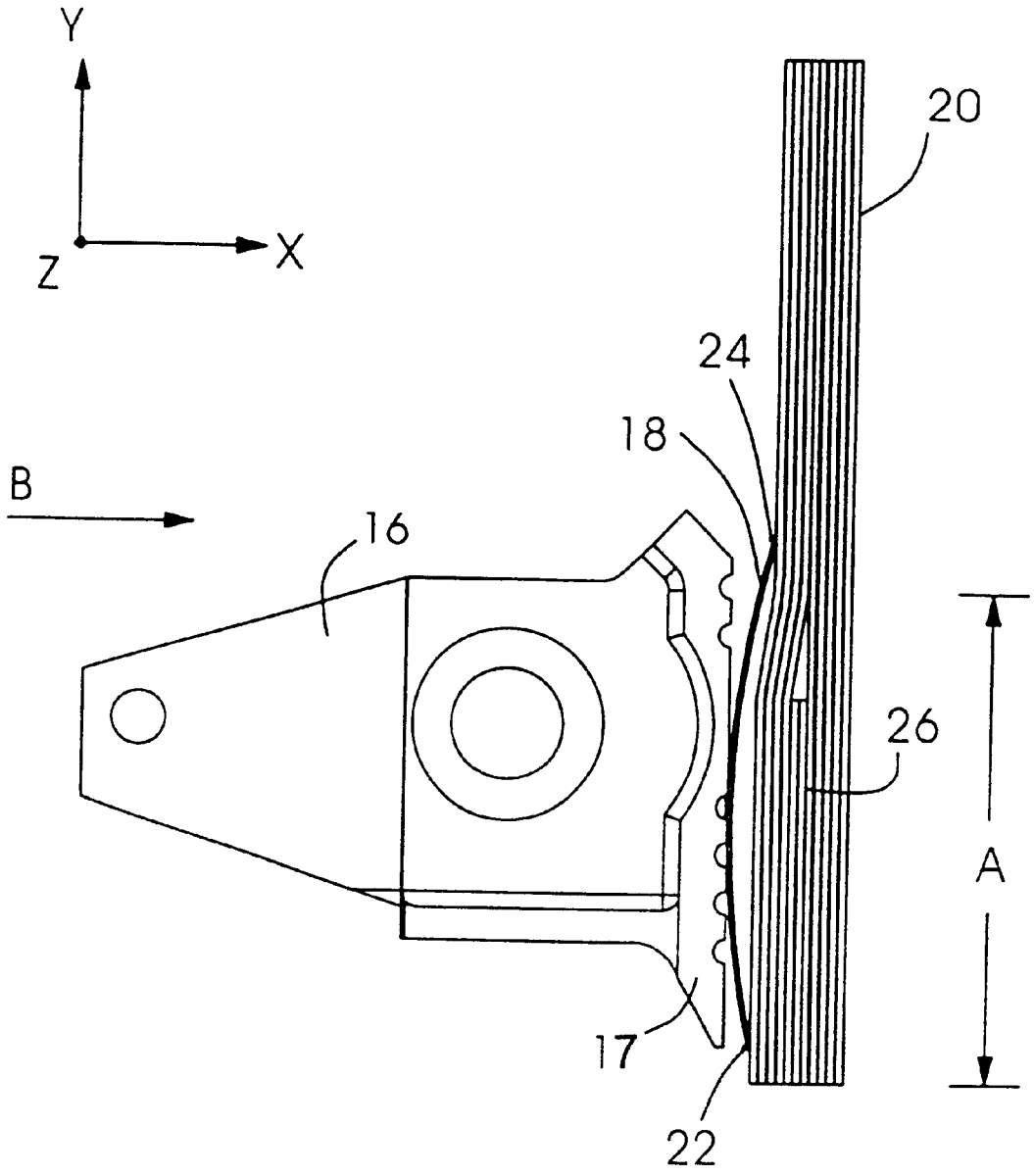
FIG. 2 is a schematic side view of the pressure plate of second clamp member of the book clamp.

Referring now to FIG. 2 a schematic side view of pressure plate 16 which may be part of the second clamp member 12 itself or which may be attached to the second clamp member. A spring plate 18 is attached to an end 17 of the pressure plate 16 facing the book 20. The end 17 can have a face with indentations. The spring plate 18 is of a convex cross-sectional shape and therefore touches the book 20 at point 22 and 24. Due to the presence of an insert 26 the book 20 has an increased thickness in the region indicated by the distance A. When the first and second clamp members 10, 12 clamp the book 20, the spring plate 18 touches the book at points 22, 24. Increasing the pressure at the book 20 by moving the pressure plate 16 into the direction given by the arrow B leads to an increasing pressure at the touch points 22, 24.

Figure 3:
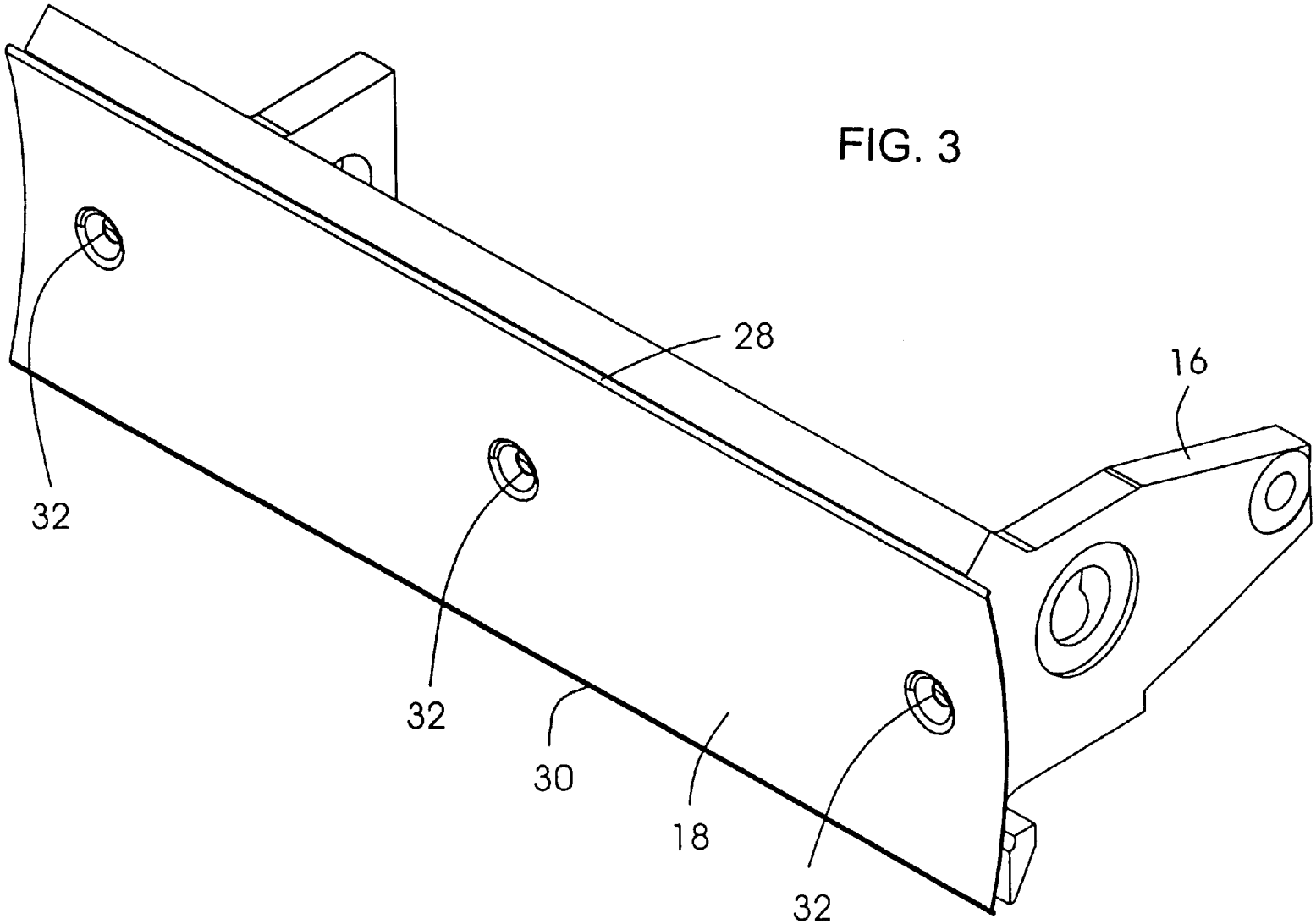
FIG. 3 is a schematic perspective view of the second clamp member of the book clamp.

The pressure exerted to the book 20 therefore is independent from the thickness and any thickness variation along the y or z directions of the book. Therefore any thickness variations in the y or z direction of the book can be compensated by attaching a flexible spring plate to the pressure plate 16. FIG. 3 depicts a schematic perspective view of the pressure plate 16 of the book clamp. The pressure plate 16 has a flexible spring plate 18 being substantially of a concave cross-sectional shape but being bent convex at the edges 28 and 30. The slightly convex edges avoid any marking or any damage of the book 20 during the procedure of clamping the book. The spring plate 18 may be attached to the pressure plate 16 by fasteners 32 such as rivets, or screws, preferably sunk screws or counter-sunk-screws.

Figure 4:
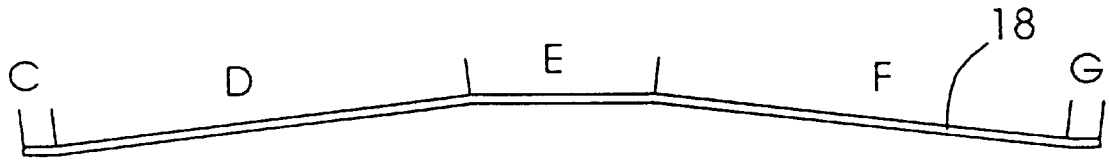
FIG. 4 is a schematic sectional view of a possible shape of flexible spring plate.

In a further embodiment of the invention, given in FIG. 4, the flexible spring plate 18 may have another cross sectional shape, e.g. the cross sectional shape of a polygon. This polygon is composed of a plurality of linear parts as indicated, for example, by the sections C, D, E, F and G. However, it is important, that the different parts of the polygon are interlinked in a way to produce a flexible spring plate 18 which may be mounted concave to the second clamp member 12.

Figure 5:
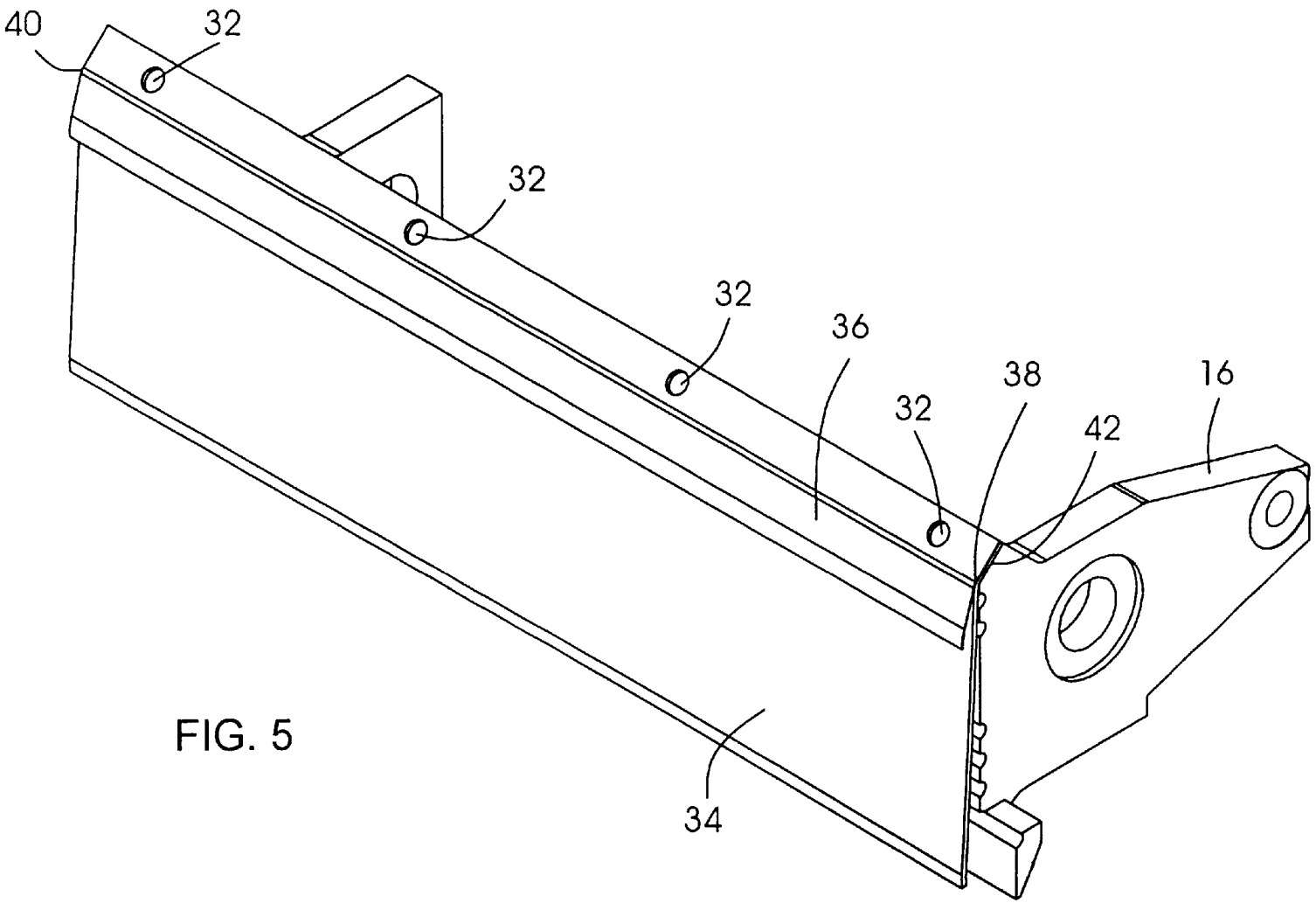
FIG. 5 is a perspective view of second clamp member of the book clamp in a second embodiment.

Further embodiment of the present invention is given in FIG. 5. The spring plates shown in the previous examples are normally attached to the pressure plate 16 by fasteners 32, such as rivets or screws where the fasteners are mounted preferably at the center of the spring plate. Under some conditions therefore these fasteners may contact with the paper and cause some undesired marking of the paper. It would be therefore of some advantage to fasten the pressure plate on the spring plate at the edge of the pressure plate so that the fasteners 32 will not be in contact with the paper. However, due to the need to generate a sufficient clamping force it is of advantage to generate a two line touch of the book during pressing the clamping plate against the book. For this purpose, as shown in FIG. 5, a first 34 and second 36 spring plate is mounted on an edge 42 of the pressure plate 16. Both spring plates 34, 36 are mounted on the pressure plate 16 by a plurality of fasteners 32 such as rivets or counter-sunk-screws. Both spring plates 34, 36 are bent along the line from edge point 38 to edge point 40.

Figure 6:
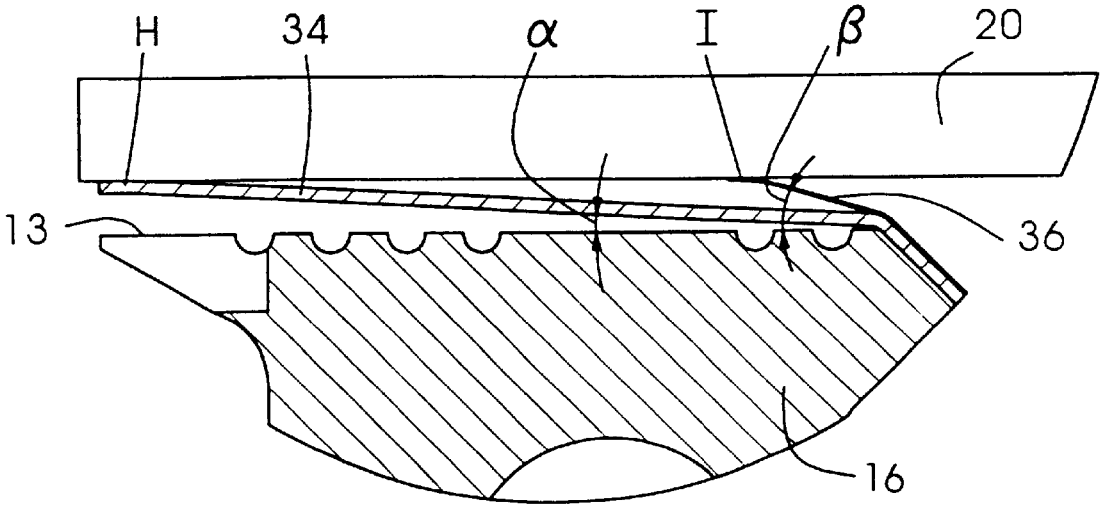
FIG. 6 is a schematic sectional view of the second clamp member in a further embodiment.

As shown in FIG. 6 the first spring plate 34 is mounted to the pressure plate 16 such that an angle $\alpha$ is created between the surface 13 of the pressure plate 16 and the first spring plate 34. The second spring plate 36 is attached to the pressure plate 16 such that the surface 13 of the pressure plate 16 and the spring plate 36 are arranged in an angle $\beta$, where $\beta$ is greater than the angle $\alpha$. The range of angles of $\alpha$ lies below 45°, preferably below 30° and most preferably between 1° and 10°. The ranges of $\beta$ lies below 60°, preferably below 40° and most preferably between 2° and 15°.

When a book 20 is pressed against the pressure plate 16 comprising two spring plates 34, 36 it will come into contact with both spring plates 34, 36 at points H and I, as shown in the cross sectional view of FIG. 6. With this embodiment of the invention it is therefore possible to achieve a two line; contact of the pressure plates with the books to be clamped and, as a consequence, to achieve the desired clamping force.

Any of the flexible spring plates described above can be made of any suitable material, e.g. of polymers, such as polyethylene, polypropylene, polystyrene, and so on, or of metal, such as a bent sheet metal. As already described above the flexible spring plates may be coupled, especially mounted to the second clamp member by rivets or screws. In the embodiment of the invention where at least two flexible spring plates are mounted on one clamp member the first and second flexible spring plates preferably are of different size or shape and are preferably mounted to the pressure plate 16 at the same mounting points, e.g. by using the same screw or rivet for both spring plates at one mounting point. The compression force of the first and second pressure plate can be adjusted by using the desired material or by choosing different thicknesses of the pressure plates. As one of the spring plates generally is shorter than the other. The shorter plate requires a lower thickness as it has a shorter moment arm. Without further analyses the foregoing will so fully review the gist of the present invention that others can applying current knowledge readily adapted for various application without permitting features that from the stand point of prior art fairly constitute essential characteristics of the generic or specific aspects of this invention and therefore such adaptations should and are intended to be comprehended within the meaning and range of equivalence of the following claims.

We claim:

1. A book clamp for a book binding machine, the book clamp comprising:

a first clamp member;

a second clamp member connected to said first clamp member; and a pressure plate connected to said second clamp member, said pressure plate having a flexible spring plate for pressing a book against said first clamp member, said flexible spring plate defining a concave surface facing said first clamp member.

2. The book clamp according to claim 1, wherein said flexible spring plate is mounted on said pressure plate facing said first clamp member.

3. The book clamp according to claim 1, wherein said flexible spring plate is screwed to said pressure plate.

4. The book clamp according to claim 1, wherein said flexible spring plate is riveted on said pressure plate.

5. The book clamp according to claim 1, wherein said flexible spring plate has a concave cross sectional shape.

6. The book clamp according to claim 1, wherein said pressure plate has a second flexible spring plate for pressing a book against said first clamp member.

7. The book clamp according to claim 1, wherein said second clamp member is pivotally connected to said first clamp member.

8. The book clamp according to claim 1, wherein said pressure plate is pivotally connected to said second clamp member.

9. The book clamp according to claim 1, wherein said flexible spring plate is curved.

10. The book clamp according to claim 6, wherein said second flexible spring plate has a different size and shape than said flexible spring plate.

11. The book clamp according to claim 6, wherein said second flexible spring plate has an overlap portion and a portion of said first flexible spring plate overlaps said overlap portion.

12. A book clams for a book binding machine, the book clamp comprising:

a first clamp member; and a second clamp member adapted to said first clams member, said second clamp member having a flexible spring plate with a cross sectional shape of a polygon.

13. A book clamp for a book binding machine, the book clamp comprising:

a first clamp member; and a second clamp member adapted to said first clamp member, said second clamp member having first and second flexible spring plates, said second flexible spring plate having a different size and shape than said first flexible spring plate.

14. The book clamp according to claim 13, wherein said second clams member has a mounting edge and said first and second flexible spring plates are mounted to said mounting edge at mounting points.

15. A book clamp for a book binding machine, the book clamp comprising:

a first clamp member;

a second clamp member connected to said first clamp member; and a pressure plate connected to said second clamp member, said pressure plate having a flexible spring plate for pressing a book against said first clamp member and a second flexible spring plate for pressing a book against said first clamp member, said second flexible spring plate having a different size and shape than said flexible spring plate.

16. A book clamp for a book binding machine, the book clamp comprising:

a first clamp member;

a second clamp member connected to said first clamp member; and a pressure plate connected to said second clamp member, said pressure plate having a flexible spring plate for pressing a book against said first clamp member and a second flexible spring plate for pressing a book against said first clamp member, said second flexible spring plate having an overlap portion and a portion of said first flexible spring plate overlaps said overlap portion.

17. The book clamp according to claim 16, wherein said second clamp member has a mounting edge and said first and second flexible spring plates are mounted to said mounting edge.

* * * * *